US008152501B2

(12) United States Patent
Fujita et al.

(10) Patent No.: US 8,152,501 B2
(45) Date of Patent: Apr. 10, 2012

(54) SCROLL COMPRESSOR FOR PREVENTING PERFORMANCE DETERIORATION AND VARIATION DUE TO GAS LEAKAGE

(75) Inventors: Katsuhiro Fujita, Aichi (JP); Tomohisa Moro, Aichi (JP); Hirohumi Hirata, Aichi (JP); Masahiro Ohta, Aichi (JP); Kazuhide Watanabe, Aichi (JP); Takayuki Kuwahara, Aichi (JP); Makoto Takeuchi, Aichi-ken (JP); Tetuzou Ukai, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 569 days.

(21) Appl. No.: 12/227,401

(22) PCT Filed: Sep. 18, 2008

(86) PCT No.: PCT/JP2008/066873

§ 371 (c)(1),
(2), (4) Date: Nov. 17, 2008

(87) PCT Pub. No.: WO2009/038138

PCT Pub. Date: Mar. 26, 2009

(65) Prior Publication Data

US 2010/0172780 A1 Jul. 8, 2010

(30) Foreign Application Priority Data

Sep. 21, 2007 (JP) ..... 2007-245089

(51) Int. Cl.
*F03C 2/00* (2006.01)
*F03C 4/00* (2006.01)
*F04C 2/00* (2006.01)

(52) U.S. Cl. ..... 418/55.4; 418/55.2; 418/55.5; 418/57; 418/142; 418/150

(58) Field of Classification Search ..... 418/55.1–55.6, 418/57, 150, 142
See application file for complete search history.

(56) References Cited

U.S. PATENT DOCUMENTS 4,869,658 A * 9/1989 Tsutsumi et al. ..... 418/55.4
(Continued)

FOREIGN PATENT DOCUMENTS

| | | | | |
|---|---|---|---|---|
| JP | 59176485 A | * | 10/1984 | ..... 418/142 |
| JP | 02181082 A | * | 7/1990 | ..... 418/55.4 |
| JP | 4-255588 A | | 9/1992 | |
| JP | 06042472 A | * | 2/1994 | ..... 418/55.4 |
| JP | 2002-138975 A | | 5/2002 | |

OTHER PUBLICATIONS

International Search Report mailed Dec. 16, 2008, in corresponding International Application No. PCT/JP2008/066873.

*Primary Examiner* — Theresa Trieu
(74) *Attorney, Agent, or Firm* — Westerman, Hattori, Daniels & Adrian, LLP

(57) ABSTRACT

In a scroll compressor configured to be capable of three-dimensional compression in a circumferential direction and a height direction of spiral wraps, in which top surfaces and bottom surfaces of spiral wraps (25B and 27B) are provided with step portions (25E and 27E) and the wrap height on the outer peripheral side of the step portion is made higher than the wrap height on the inner peripheral side, back-pressure introducing portions (55 and 57) where gaps between the back surfaces at step-portion ends of tip seals and groove bottom surfaces of tip seal grooves are made larger than a gap at the other portion are formed between the step-portion ends of tip seals (51 and 53) provided on top surfaces (25G and 27G) on the outer peripheral side of the spiral wraps and tip seal grooves (25L and 27L) to which the tip seals are fitted.

9 Claims, 8 Drawing Sheets

U.S. PATENT DOCUMENTS 6,585,501 B2 * 7/2003 Takeuchi et al. ..... 418/55.2
7,134,852 B1 11/2006 Lai
2002/0054821 A1 5/2002 Takeuchi et al.
2003/0194341 A1 10/2003 Takeuchi et al.

* cited by examiner

SCROLL COMPRESSOR FOR PREVENTING PERFORMANCE DETERIORATION AND VARIATION DUE TO GAS LEAKAGE

TECHNICAL FIELD

The present invention relates to a scroll compressor having a step portion on each of a top surface and a bottom surface of a spiral wrap, the wrap height of the spiral wrap on the outer peripheral side of the step portion is made higher than the wrap height on the inner peripheral side, so as to enable three-dimensional compression in a circumferential direction and a height direction of the spiral wrap.

BACKGROUND ART

As a scroll compressor whose compressor capacity can be increased without increasing the outside diameter of a scroll member, a scroll compressor has been proposed in which a top surface and a bottom surface of spiral wraps of a fixed scroll member and an orbiting scroll member, forming a pair, are each provided with a step portion, the wrap height of the spiral wraps on the outer peripheral side of the step portions is made higher than the wrap height on the inner peripheral side, so as to enable three-dimensional compression in a circumferential direction and a height direction of the spiral wraps. Because this compressor is capable of compression not only in the circumferential direction of the spiral wraps but also in the wrap height direction, it is possible to increase the displacement and increase the compressor capacity compared with a typical scroll compressor (two-dimensional compression) having no step portion, as described above. Accordingly, compared with a compressor having the same capacity, there are advantages in that, among others, it is possible to reduce the size and weight.

Patent Document 1 discloses that, in a scroll compressor capable of three-dimensional compression, as described above, the top surfaces on the outer peripheral side and on the inner peripheral side of the step portion of the spiral wrap are each provided with a tip seal, and a tip seal groove on the outer peripheral side is provided with an introduction path through which internal pressure in a high-pressure compression chamber on the center side is introduced, whereby the sealing function of the tip seal on the outer peripheral side is enhanced to reduce the amount of gas leakage from the top surface of the wrap on the outer peripheral side of the step portion of the spiral wrap and to improve the compression efficiency.

Patent Document 2 discloses that, in a scroll compressor having a typical structure in which the top surface and the bottom surface of the spiral wrap are not provided with the step portion as mentioned above, a back-pressure guide portion formed by thinning the seal end or by deepening the seal groove end is provided at the spiral starting end of the tip seal or the tip seal groove. By making the back-pressure guide portion flexurally deform, thermal expansion deformation is absorbed, thus obtaining uniform sealing properties of the tip seal and preventing abnormal abrasion, which improves the durability and the reliability.

Patent Document 1: Japanese Unexamined Patent Application, Publication No. 2002-138975

Patent Document 2: Japanese Unexamined Patent Application, Publication No. Hei 4-255588

DISCLOSURE OF INVENTION

The disclosure in Patent Document 1 is intended to improve functional deterioration of the tip seal provided on the top surface on the outer peripheral side of the step portion of the wrap of the scroll compressor capable of three-dimensional compression. However, in the disclosure in Patent Document 1, there are concerns about the problem of processability of a high-pressure introduction path provided on the spiral wrap and the influence of the introduction path on the wrap strength. Further, a countermeasure against thermal deformation in the vicinity of the step portion, at which the height of the spiral wrap increases, is insufficient. That is, in the scroll compressor capable of three-dimensional compression, compared to a scroll compressor of a typical structure with no step portion, the temperature of the compression chamber is high within an orbiting angle range where the step portion is contained inside the compression chamber. In addition, because the height of the spiral wrap increases at the step portion, displacement of the spiral wrap in the height direction due to thermal expansion increases (refer to FIGS. 6 and 7). Accordingly, the problem remains that, unless a countermeasure sufficiently taking into consideration thermal deformation occurring at the step portion is taken, a movable gap of the tip seal is narrowed, whereby even if a high-pressure introduction path is provided, the tip seal provided on the outer peripheral side of the step portion cannot function sufficiently, causing performance deterioration or performance variation due to gas leakage.

The disclosure in Patent Document 2 is intended to suppress the influence of thermal deformation of the tip seal occurring at the spiral starting end on the inner peripheral end of the spiral wrap of a typical scroll compressor to obtain a uniform sealing property, and is not intended to overcome the challenge of reducing gas leakage from the top surface of the wrap on the outer peripheral side of the step portion of the spiral wrap of a scroll compressor capable of three-dimensional compression. Patent Document 2 neither suggests nor teaches, at all, how the step portions provided on the top surface and bottom surface of the spiral wrap are thermally influenced during operation of the compressor, and how the thermal influence on the step portions influences gas leakage from the top surface of the wrap on the outer peripheral side of the step portion, i.e., the compression performance.

As has been described, in the scroll compressor capable of three-dimensional compression, reduction in gas leakage from the top surface of the wrap on the outer peripheral side of the step portion by absorbing the thermal deformation in the vicinity of the step portion is an urgent challenge expected to be overcome in achieving stabilized compression performance and performance improvement of a scroll compressor having the aforementioned configuration.

The present invention has been made in view of the above-described circumstances, and an object thereof is to provide a scroll compressor capable of three-dimensional compression in which performance deterioration and performance variation due to gas leakage occurring on the outer peripheral side of the step portion of the spiral wrap can be prevented and stabilization of compression performance and performance improvement can be achieved.

To solve the above-described problems, a scroll compressor of the present invention employs the following solutions.

That is, a scroll compressor according to a first aspect of the present invention is a scroll compressor having a step portion on each of a top surface and a bottom surface of a spiral wrap of a fixed scroll member and an orbiting scroll member pair, each formed of an end plate and the spiral wrap mounted upright thereon, the height of the spiral wrap on an outer peripheral side of the step portion being made higher than the height of the spiral wrap on an inner peripheral side, the scroll compressor being configured to be capable of three-dimensional compression in a circumferential direction and a height direction of the spiral wrap, the top surfaces on the outer peripheral side and on the inner peripheral side of the spiral wrap each being provided with a tip seal. A back-pressure introducing portion where a gap between a back surface at a step-portion end of the tip seal and a groove bottom surface of a tip seal groove is made larger than a gap at the other portion is provided between the step-portion end of the tip seal provided on the top surface on the outer peripheral side of the spiral wrap and the tip seal groove to which the tip seal is fitted.

In the scroll compressor configured to be capable of three-dimensional compression, because the rate of decease of displacement (volume change rate) increases within an orbiting angle range where the step portion is contained inside the compression chamber, the temperature of the compression chamber is higher than the temperature of the compression chamber of a typical scroll compressor having no step portion in the same orbiting angle range. Furthermore, because the height of the spiral wrap increases in the vicinity of the step portion of the wrap top surfaces, displacement of the spiral wrap in the height direction due to thermal expansion also locally increases. This narrows the gap between the tip seal and the bottom surface of the counterpart scroll member and the gap at the back surface of the tip seal during thermal deformation, making it difficult to allow back-pressure (gas being compressed) to enter the back surface of the tip seal from the step-portion end. This degrades the function of the tip seal provided on the outer peripheral side of the step portion of the spiral wrap, causing performance deterioration and performance variation due to gas leakage.

According to the first aspect of the present invention, because the back-pressure introducing portion at which the gap between the back surface of the step-portion end of the tip seal and the groove bottom surface of the tip seal groove is made larger than the gap at the other portion is provided between the step-portion end of the tip seal and the tip seal groove to which the tip seal is fitted, even if the vicinity of the step portion of the spiral wrap is displaced in the wrap height direction because of thermal expansion, the gap at the back-pressure introducing portion is not narrowed, whereby back-pressure (gas being compressed) can be assuredly introduced from the step-portion end to the back surface of the tip seal provided on the outer peripheral side of the step portion of the spiral wrap through the back-pressure introducing portion. Thus, thermal deformation is absorbed to make the tip seal provided on the outer peripheral side of the step portion function normally, whereby the tip seal is urged against the bottom surface of the counterpart scroll member by back-pressure, and the top surface of the spiral wrap can be assuredly sealed. Accordingly, it is possible to prevent performance deterioration and performance variation due to gas leakage occurring on the outer peripheral side of the step portion of the spiral wrap to achieve performance stabilization and performance improvement of the scroll compressor capable of three-dimensional compression.

Furthermore, in the scroll compressor according to the first aspect, in the above-described scroll compressor, the back-pressure introducing portion may be formed by boring a groove bottom surface at the step-portion end of the tip seal groove more deeply than a groove bottom surface of the other portion.

According to the first aspect, because the back-pressure introducing portion is formed by boring the groove bottom surface at the step-portion end of the tip seal groove more deeply than the groove bottom surface of the other portion, the back-pressure introducing portion can be easily formed. Furthermore, by introducing back-pressure to the back surface of the tip seal through this back-pressure introducing portion, thermal deformation is absorbed to make the tip seal on the outer peripheral side of the step portion function normally. Accordingly, a countermeasure against thermal deformation of the step portions can be taken easily and at low cost by partial improvement of existing components, without adding new components, etc.

In addition, in the scroll compressor according to the first aspect, in the above-described scroll compressor, the back-pressure introducing portion may be formed by providing a notch in the back surface at the step-portion end of the tip seal.

According to the first aspect, because the back-pressure introducing portion is formed by forming the notch in the back surface of the step-portion end of the tip seal, the back-pressure introducing portion can be easily formed. Furthermore, by introducing back-pressure to the back surface of the tip seal through this back-pressure introducing portion, thermal deformation is absorbed to make the tip seal on the outer peripheral side of the step portion function normally. Accordingly, a countermeasure against thermal deformation of the step portions can be taken easily and at low cost by partial improvement of existing components, without adding new components, etc.

Furthermore, in the scroll compressor according to the first aspect, in any one of the above-described scroll compressors, $b>T2$ may hold where b is the width of an edge formed at the step-portion end of the tip seal groove and T2 is the width of edges formed along and on both sides of the tip seal groove.

Because the smaller the width, b, of the edge formed at the step-portion end of the tip seal groove is made, the smaller the region without the tip seal can be made, it is possible to reduce the amount of gas leakage to enhance the performance. However, if the edge width, b, is made too small, when a load to be supported by an autorotation prevention mechanism or the like acts, as a surface pressure load, on the step portion of the spiral wrap due to the effect of errors in assembly, thermal deformation, or the like, the thinned edge of the step-portion end of the tip seal groove may be damaged because of insufficient rigidity.

According to the first aspect, because the width, b, of the edge formed at the step-portion end of the tip seal groove is made larger than the width, T2, of the edges formed along and on both sides of the tip seal groove, the rigidity of the tip seal groove at the step-portion end can be increased. Thus, while gas leakage is reduced as much as possible to maintain the performance, sufficient rigidity of the tip seal groove at the edge of the step-portion end can be ensured to improve the durability.

In addition, a scroll compressor according to a second aspect of the present invention is a scroll compressor having a step portion on each of a top surface and a bottom surface of a spiral wrap of a fixed scroll member and an orbiting scroll member pair, each formed of an end plate and the spiral wrap mounted upright thereon, the height of the spiral wrap on an outer peripheral side of the step portion being made higher than the height of the spiral wrap on an inner peripheral side, the scroll compressor being configured to be capable of three-dimensional compression in a circumferential direction and a height direction of the spiral wrap, the top surfaces on the outer peripheral side and on the inner peripheral side of the spiral wrap each being provided with a tip seal, in which $b>T2$ holds where b is the width of an edge formed at the step-portion end of the tip seal groove to which the tip seal is fitted, the tip seal groove being provided in the top surface on the outer peripheral side of the spiral wrap, and T2 is the width of edges formed along and on both sides of the tip seal groove.

According to the second aspect of the present invention, because the width, b, of the edge formed at the step-portion end of the tip seal groove is made larger than the width, T2, of the edges formed along and on both sides of the tip seal groove, the rigidity of the tip seal groove at the step-portion end can be increased. Because the smaller the width, b, of the edge formed at the step-portion end of the tip seal groove is made, the smaller the region without the tip seal can be made, it is possible to reduce the amount of gas leakage to enhance the performance. However, if the edge width, b, is made too small, when a load to be supported by an autorotation prevention mechanism or the like acts, as a surface pressure load, on the step portion of the spiral wrap due to the effect of errors in assembly, thermal deformation, or the like, the thinned edge of the step-portion end of the tip seal groove may be damaged because of insufficient rigidity. By defining the edge width b as b>T2, while gas leakage is reduced as much as possible to maintain the performance, sufficient rigidity of the tip seal groove at the edge of the step-portion end can be ensured to improve the durability, whereby damage to the edge of the step-portion end due to unforeseen circumstances can be prevented.

Furthermore, in the scroll compressor according to the second aspect, in any one of the above-described scroll compressors, the edge width b with respect to the edge width T2 may be set to be b≦2.5*T2.

According to the second aspect, because the width, b, of the edge formed at the step-portion end of the tip seal groove with respect to the width, T2, of the edges formed along and on both sides of the tip seal groove is set to be b≦2.5*T2, the region without the tip seal can be made at most 2.5 times the edge width T2. Thus, while gas leakage is reduced as much as possible to maintain the performance without unnecessarily increasing the edge width b portion, where the effect of the tip seal cannot be obtained, sufficient rigidity of the edge of the step-portion end of tip seal groove can be ensured.

In addition, in the scroll compressor according to the second aspect, in any one of the above-described scroll compressors, the edge width b may be set to be 1 mm<b≦2.5 mm.

According to the second aspect, because the width, b, of the edge formed at the step-portion end of the tip seal groove is set to be 1 mm<b≦2.5 mm, the region without the tip seal can be made in the range of 1 mm to 2.5 mm. Thus, the edge width b can be made in the optimum range, and while gas leakage is reduced as much as possible to maintain the performance, sufficient rigidity of the edge of the step-portion end of tip seal groove can be ensured.

Furthermore, a scroll compressor according to a third aspect of the present invention is a scroll compressor having a step portion on each of a top surface and a bottom surface of a spiral wrap of a fixed scroll member and an orbiting scroll member pair, each formed of an end plate and the spiral wrap mounted upright thereon, the height of the spiral wrap on an outer peripheral side of the step portion being made higher than the height of the spiral wrap on an inner peripheral side, the scroll compressor being configured to be capable of three-dimensional compression in a circumferential direction and a height direction of the spiral wrap, the top surfaces on the outer peripheral side and on the inner peripheral side of the spiral wrap each being provided with a tip seal. The step-portion end of the tip seal groove to which the tip seal is fitted penetrates through to the step portion, the tip seal groove being provided in the top surface on the outer peripheral side of the spiral wrap, the tip seal fitted to the tip seal groove is provided such that it extends to an end of the tip seal groove, and a movement preventing portion for preventing the tip seal from moving in a spiral direction is provided at at least one place in the spiral direction.

According to the third aspect, because the step-portion end of the tip seal groove to which the tip seal is fitted penetrates through to the step portion, the tip seal groove being provided in the top surface on the outer peripheral side of the spiral wrap, and the tip seal fitted to the tip seal groove is provided so as to extend to the end of the tip seal groove, even if the vicinity of the step portion of the spiral wrap is displaced in the wrap height direction due to thermal expansion, such displacement can be absorbed to assuredly introduce back-pressure (gas being compressed) from the penetrated portion of the step portion of the tip seal groove to the back surface of the tip seal. This causes the tip seal to be urged against the bottom surface of the counterpart scroll member by the back-pressure, whereby the top surface of the spiral wrap can be assuredly sealed. Thus, it is possible to prevent performance deterioration and performance variation due to gas leakage occurring on the outer peripheral side of the step portion of the spiral wrap to achieve performance stabilization and performance improvement of the scroll compressor capable of three-dimensional compression. Furthermore, because the tip seal is provided on the top surface on the outer peripheral side of the step portion of the spiral wrap such that it extends to the extremity of the step-portion end, gas leakage from the aforementioned position can be further reduced to improve the performance. In addition, because the movement preventing portion is provided at one place in the spiral direction of the tip seal, even though the tip seal groove is provided such that it penetrates through to the step portion, the tip seal can be assuredly prevented from moving in the spiral direction and sliding out through the penetrated portion.

Furthermore, in the scroll compressor according to the third aspect, in the above-described scroll compressor, the movement preventing portion may be formed of a dowel provided on one of the tip seal and the tip seal groove and a recess to which the dowel is fitted, provided in the other.

According to the third aspect of the present invention, because the movement preventing portion is formed of the dowel provided on one of the tip seal and the tip seal groove and the recess provided in the other, neither the structure nor strength of the spiral wrap and the tip seal is affected at all, whereby the movement preventing portion can be easily formed. Accordingly, while movement of the tip seal can be assuredly prevented, attachment of the tip seal can be easily performed.

In addition, in the scroll compressor according to the third aspect, in any one of the above-described scroll compressors, a back-pressure introducing portion may be provided at the step-portion end of the tip seal and/or the tip seal groove.

According to the third aspect, because the back-pressure introducing portion is provided at the step-portion end of the tip seal and/or the tip seal groove, even if the vicinity of the step portion of the spiral wrap is displaced in the wrap height direction due to thermal expansion, back-pressure (gas being compressed) can be assuredly introduced from the penetrated portion of the step portion of the tip seal groove to the back surface of the tip seal through the back-pressure introducing portion. Thus, thermal deformation is absorbed to make the tip seal provided on the outer peripheral side of the step portion function normally, whereby performance deterioration and performance variation due to gas leakage occurring on the outer peripheral side of the step portion of the spiral wrap can be prevented.

According to the present invention, the tip seal on the outer peripheral side of the step portion can be made to function normally, the tip seal can be urged against the bottom surface of the counterpart scroll member by back-pressure, and the top surface of the spiral wrap can be assuredly sealed. Accordingly, it is possible to prevent performance deterioration and performance variation due to gas leakage occurring on the outer peripheral side of the step portion of the spiral wrap to achieve stabilization and improvement of the performance of the scroll compressor capable of three-dimensional compression.

EXPLANATION OF REFERENCE SIGNS

1: scroll compressor
25: fixed scroll member
27: orbiting scroll member
25A and 27A: end plate
25B and 27B: spiral wrap
25C, 25G and 25H, 27C, 27G and 27H: top surface
25D and 27D: bottom surface
25E and 25F, 27E, 27F: step portion
25L and 25M, 27L and 27M, 65L, 67L: tip seal groove
25N, 27N: deep bore portion
51, 52, 53, 54, 71, 73: tip seal
51A, 53A: notch
55, 57: back-pressure introducing portion
65P, 67P: recess
65Q, 67Q: back-pressure introducing recess
71A, 73A: dowel
b: edge width of the step-portion end of the tip seal groove
T2: edge width of both sides of the tip seal groove

BEST MODE FOR CARRYING OUT THE INVENTION

Embodiments of the present invention will be described below with reference to the drawings.

First Embodiment

A first embodiment of the present invention will be described below with reference to FIGS. 1 to 8.

Figure 1:
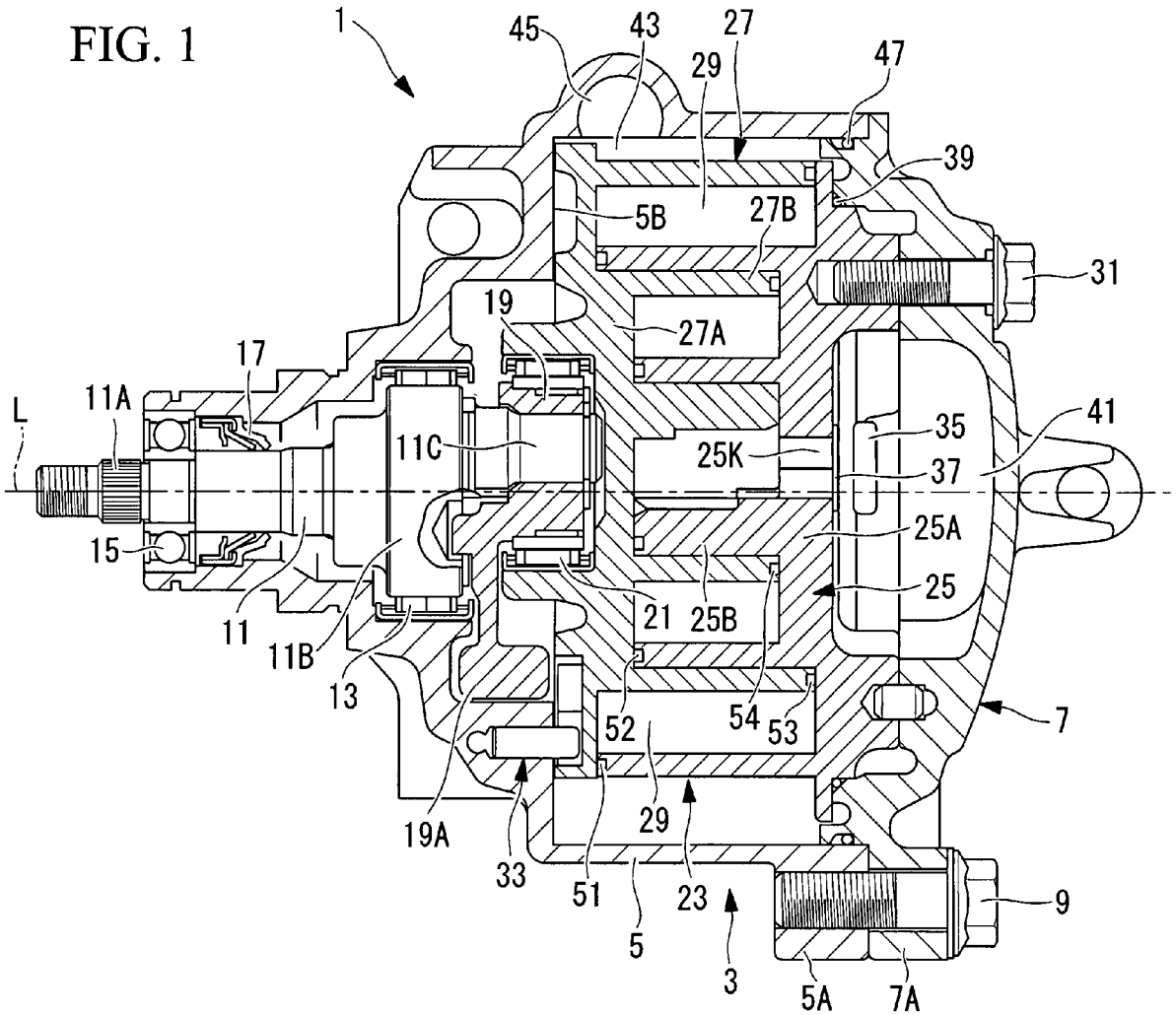
FIG. 1 is a longitudinal sectional view of a scroll compressor according to a first embodiment of the present invention.

FIG. 1 is a longitudinal sectional view of a scroll compressor 1 according to the first embodiment of the present invention. The scroll compressor 1 has a housing 3 that generally defines the external shape thereof. The housing 3 is formed by integrally and securely fastening a front housing 5 and a rear housing 7 with bolts 9 (second bolt). The front housing 5 and the rear housing 7 have fastening flanges 5A and 7A, respectively, that are formed integrally therewith at an equally spaced plurality of positions, for example, four positions, on the circumferences thereof. By fastening these flanges 5A and 7A with the bolts 9, the front housing 5 and the rear housing 7 are integrally connected.

Inside the front housing 5, a crankshaft 11 is supported via a main bearing 13 and a sub-bearing 15 in a rotatable manner about an axis L. One end (in the drawing, the left side) of the crankshaft 11 serves as a small-diameter shaft portion 11A, and the small-diameter shaft portion 11A penetrates the front housing 5 and projects to the left side in FIG. 1. As is commonly known, the projected portion of the small-diameter shaft portion 11A is provided with an electromagnetic clutch, a pulley, etc. (not shown) for receiving power, to which power from a driving source such as an engine (not shown) is transmitted via a V-belt or the like. A mechanical seal (lip seal) 17 is provided between the main bearing 13 and the sub-bearing 15 to provide an airtight seal between the inside of the housing 3 and the atmosphere.

The other end (in the drawing, the right side) of the crankshaft 11 is provided with a large-diameter shaft portion 11B, and the large-diameter shaft portion 11B is integrally provided with an eccentric pin 11C that is off-center by a predetermined dimension with respect to the axis L of the crankshaft 11. By being supported by the main bearing 13 and the bearing 15 at the above-described large-diameter shaft portion 11B and the small-diameter shaft portion 11A, the crankshaft 11 is rotatably supported by the front housing 5. An orbiting scroll member 27 described below is connected to the eccentric pin 11C via a drive bush 19 and a drive bearing 21. The orbiting scroll member 27 is orbitally driven by rotating the crankshaft 11.

A balance weight 19A for removing an unbalanced load generated by the orbiting scroll member 27 being orbitally driven is formed integrally with the drive bush 19 and is configured to orbit with the orbital driving of the orbiting scroll member 27.

The fixed scroll member 25 and the orbiting scroll member 27, which form a pair constituting the scroll compression mechanism 23, are incorporated inside the housing 3. The fixed scroll member 25 is formed of an end plate 25A and a spiral wrap 25B provided upright on the end plate 25A. On the other hand, the orbiting scroll member 27 is formed of an end plate 27A and a spiral wrap 27B provided upright on the end plate 27A.

Figure 2A:
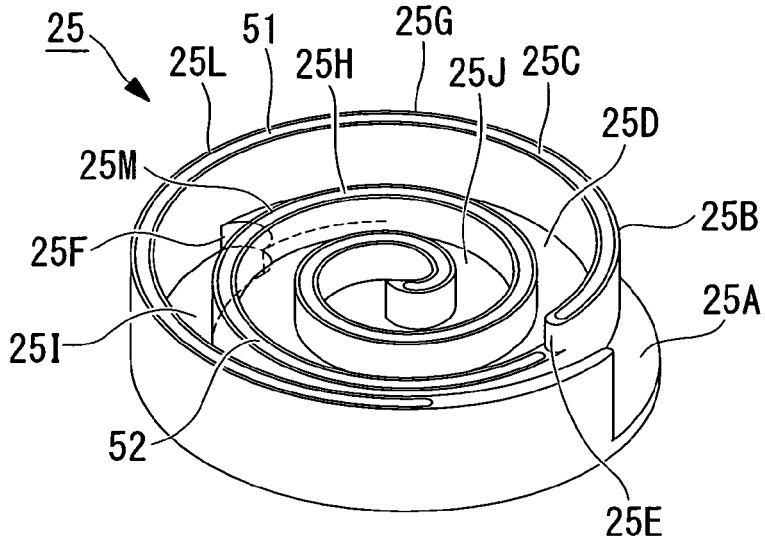
FIG. 2A is a perspective view of a fixed scroll member of the scroll compressor shown in FIG. 1.
Figure 2B:
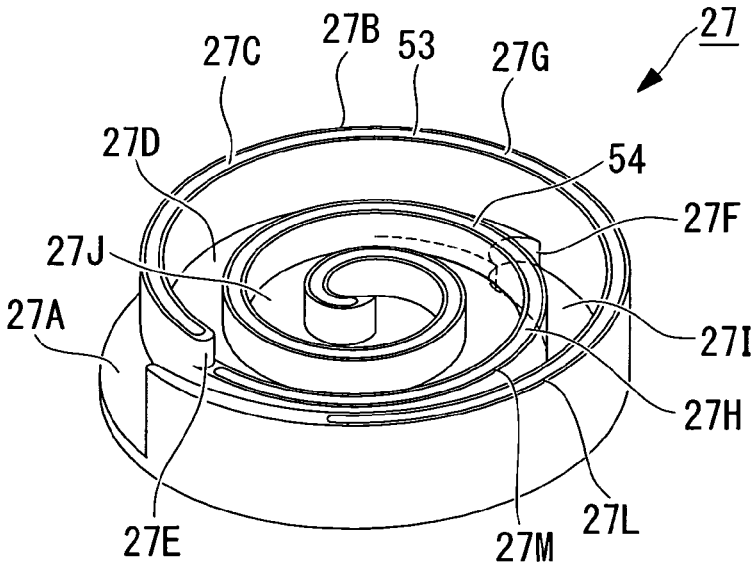
FIG. 2B is a perspective view of an orbiting scroll member of the scroll compressor shown in FIG. 1.

As shown in FIGS. 2A and 2B, the fixed scroll member 25 and the orbiting scroll member 27 have step portions 25E and 25F, and 27E and 27F, respectively, at predetermined locations along the spiral direction of the top surfaces 25C and 27C and the bottom surfaces 25D and 27D of the spiral wraps 25B and 27B, respectively. These step portions 25E and 25F and 27E and 27F serve as borders. In the wrap top surfaces 25C and 27C, top surfaces 25G and 27G on the outer peripheral side are raised, and the top surfaces 25H and 27H on the inner peripheral side are lowered in the axis L direction. In the bottom surfaces 25D and 27D, the bottom surfaces 25I and 27I on the outer peripheral side are lowered, and the bottom surfaces 25J and 27J on the inner peripheral side are raised in the axis L direction. Thus, in the spiral wraps 25B and 27B, the wrap height on the outer peripheral side is higher than the wrap height on the inner peripheral side. These fixed scroll member 25 and orbiting scroll member 27 may be formed by, for example, machining a necessary portion from a material forged from aluminum alloy or a material cast in cast iron.

Figure 3:
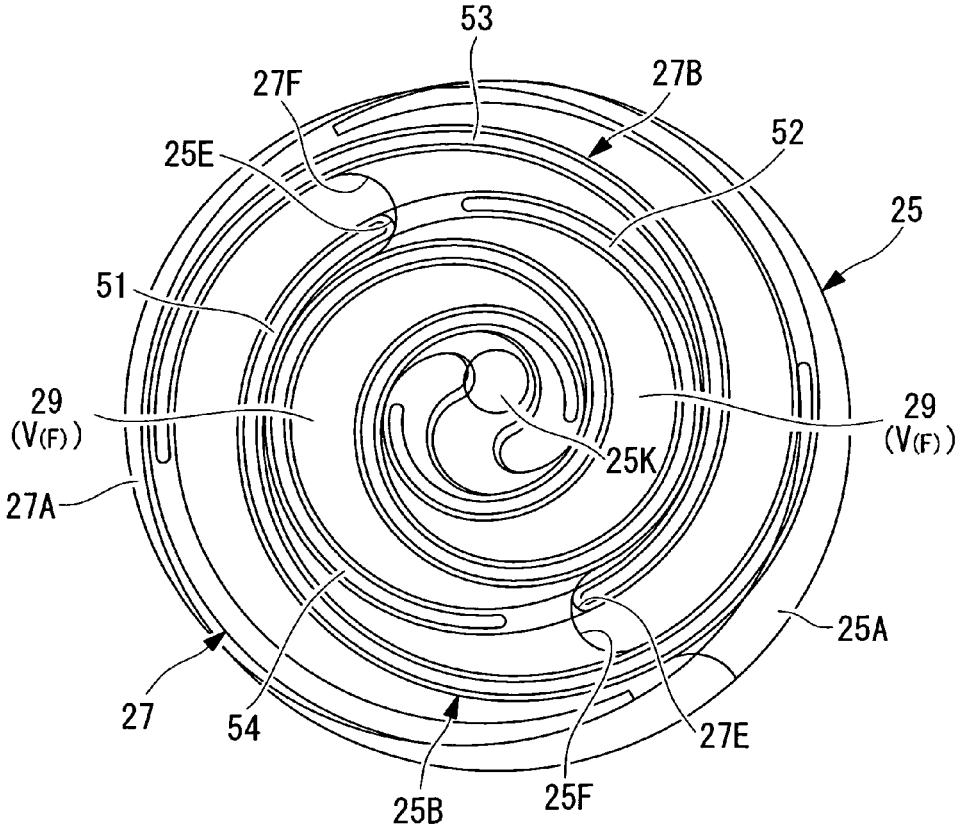
FIG. 3 is a diagram showing the fixed scroll member and the orbiting scroll member of the scroll compressor shown in FIG. 1 in an engaged state at an orbiting angle position.

The fixed scroll member 25 and the orbiting scroll member 27 are engaged such that the phases of the spiral wraps 25B and 27B are offset by 180 degrees while their centers are separated from each other by their orbital radii, and are assembled such that a slight gap (several tens to several hundreds of microns) in the wrap height direction is left between the top surfaces 25C and 27C and the bottom surfaces 25D and 27D of the spiral wraps 25B and 27B, respectively, at standard temperature. Thus, as shown in FIGS. 1 and 3, a pair of compression chambers 29 bounded by the end plates 25A and 27A and the spiral wraps 25B and 27B are formed between the two scroll members 25 and 27 symmetrically with respect to the center of scroll, and it becomes possible for the orbiting scroll member 27 to make smooth orbital motion. By making the height of the compression chamber 29 in the axis L direction higher on the outer peripheral side of the spiral wraps 25B and 27B than the inner peripheral side, a compression mechanism 23 capable of three-dimensional compression, which can compress in the circumferential direction and wrap height direction of the spiral wraps 25B and 27B, is formed.

The fixed scroll member 25 is securely installed on an inner surface of the rear housing 7 with a bolt 31 (first bolt). As described above, the eccentric pin 11C provided on one end of the crankshaft 11 is connected to a boss portion provided in the back surface of the end plate 27A via the drive bush 19 and the drive bearing 21, whereby the orbiting scroll member 27 is configured to be orbitally driven. The orbiting scroll member 27 is supported by a thrust-receiving surface 5B formed on the front housing 5, at the back surface of the end plate 27A. The orbiting scroll member 27 is configured to be orbitally driven while being revolved with respect to the fixed scroll member 25, while autorotation thereof is prevented by an autorotation prevention mechanism 33, such as a pin ring or an Oldham ring, interposed between the thrust-receiving surface 5B and the back surface of the end plate 27A.

A discharge port 25K through which compressed refrigerant gas is discharged is formed in the central portion of the end plate 25A of the fixed scroll member 25. The discharge port 25K is provided with a discharge reed valve 37 attached to the end plate 25A through a retainer 35. In addition, the end plate 25A of the fixed scroll member 25 is provided with a seal material 39 (first seal material), such as an O-ring, on the back surface side thereof such that the seal material 39 is in tight contact with the inner surface of the rear housing 7 and forms a discharge chamber 41, partitioned from the internal space of the housing 3, with the rear housing 7. Thus, the internal space of the housing 3 excluding the discharge chamber 41 is configured to function as an intake chamber 43. The intake chamber 43 takes in refrigerant gas returning from the refrigeration cycle through an intake port 45 provided in the front housing 5, and the refrigerant gas is taken into the compression chamber 29 through this intake chamber 43. A seal material 47 (second seal material), such as an O-ring, is provided at the interface between the front housing 5 and the rear housing 7, thereby airtightly sealing the intake chamber 43 formed in the housing 3 from the atmosphere.

In addition, the top surfaces 25G and 25H and 27G and 27H of the spiral wraps 25B and 27B of the fixed scroll member 25 and the orbiting scroll member 27 are provided with tip seal grooves 25L and 25M, and 27L and 27M extending along the spiral direction, whose width and depth are about half the width of the top surfaces. Tip seals 51, 52 and 53, 54 are fitted to these tip seal grooves 25L, 25M and 27L, 27M, respectively. The length and width of the tip seals 51, 52, 53, and 54, when unfolded, are made slightly smaller than the length and width of the respective unfolded tip seal grooves 25L, 25M, 27L, and 27M, corresponding thereto. Since the thickness of the tip seals 51, 52, 53, and 54 is typically 1 mm to 2 mm, the depth of the tip seal grooves 25L, 25M, 27L, and 27M is set to be substantially the same depth as the aforementioned. Thus, the tip seals 51, 52, 53, and 54 are freely movable in the tip seal grooves 25L, 25M, 27L, and 27M.

The tip seals 51, 52, 53, and 54 are made of, for example, molded plastic products such as polyphenylene sulfide (PPS), polyether ether ketone (PEEK), and polytetrafluoroethylene (PTFE), and seal the top surfaces 25G and 25H and 27G and 27H of the spiral wraps 25B and 27B by slidably contacting the bottom surfaces 25I and 25J and 27I and 27J of the counterpart scroll members 25 and 27.

The step-portion ends (inner peripheral ends) of the tip seal grooves 25L and 27L formed in the top surface 25G and 27G on the outer peripheral side of the step portions 25E and 27E are provided with back-pressure introducing portions 55 and 57 formed of deep bore portions 25N and 27N that are bored slightly more deeply than the groove bottom surface of the other portion, as shown in FIGS. 4A, 4B, 4C, and 5A. The deep bore portions 25N and 27N are bored about a few tenths of a millimeter more deeply than the groove bottom surface of the other portion and absorb deformation due to thermal expansion in the vicinity of the step portions 25E and 27E to ensure that fine gaps are always left between the back surfaces (bottom surface) of the tip seals 51 and 53 on the outer peripheral side and the bottom surfaces of the tip seal grooves 25L and 27L so as to allow back-pressure (gas being compressed) to be guided to the back surface sides of the tip seals 51 and 53.

Figure 5A:
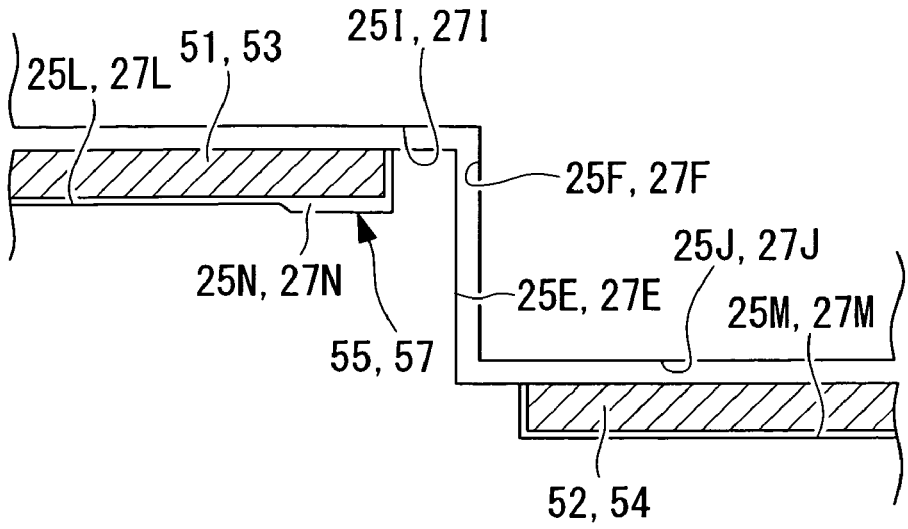
FIG. 5A is an unfolded view of the vicinity of the step portions of the fixed scroll member and the orbiting scroll member of the scroll compressor shown in FIG. 1, in an engaged state.
Figure 5B:
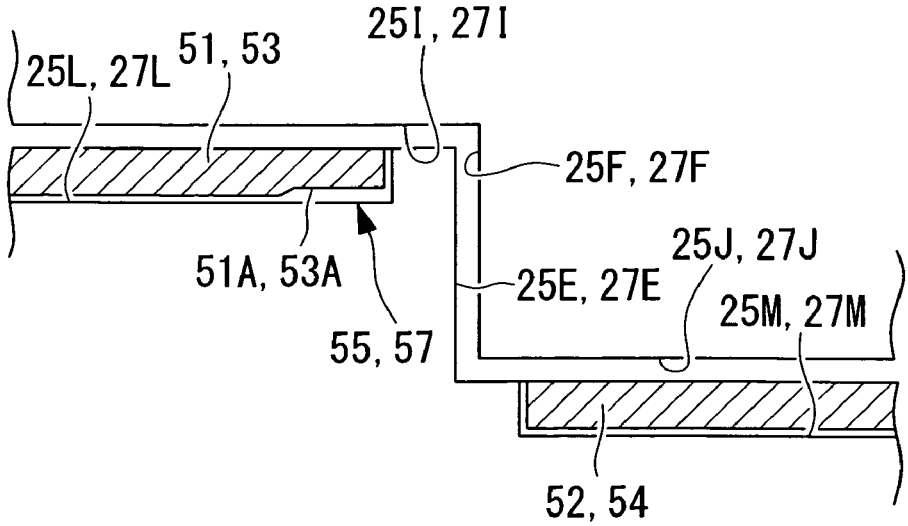
FIG. 5B is an unfolded view of a modification of the vicinity of the step portions of the fixed scroll member and the orbiting scroll member of the scroll compressor shown in FIG. 1, in an engaged state.

As shown in FIG. 5B, the back-pressure introducing portions 55 and 57 may be formed by partially providing the back surfaces (bottom surfaces) at the step-portion ends (inner peripheral ends) of the tip seals 51 and 53 with notches 51A and 53A.

Because of the above-described structure, the scroll compressor 1 according to this embodiment provides the following advantages. Since the compression operation of the scroll compressor 1 is commonly known, an explanation thereof will be omitted.

Figure 6:
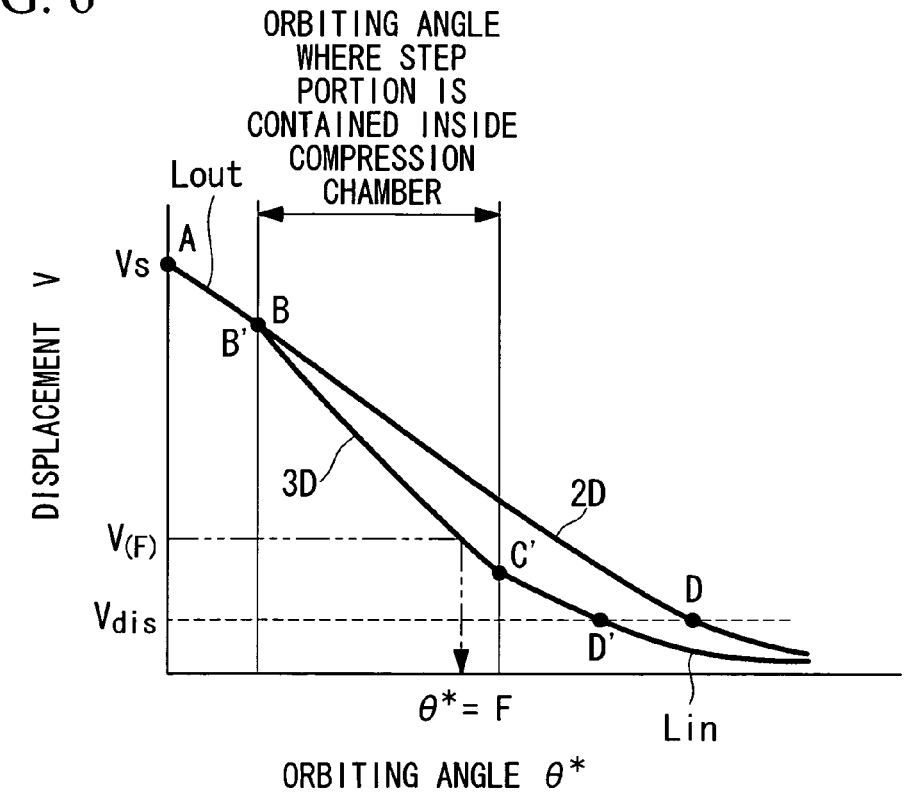
FIG. 6 is a diagram showing the relationship between the orbiting angle θ* and the displacement V, for explaining the compression action of the scroll compressor shown in FIG. 1.
Figure 7:
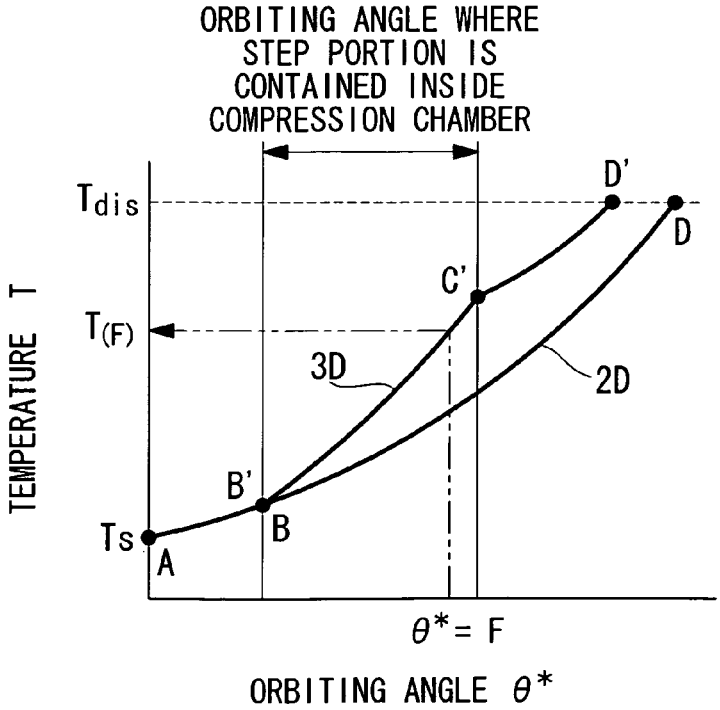
FIG. 7 is a diagram showing the relationship between the orbiting angle θ* and the temperature, T, of the compression chamber, for explaining the compression action of the scroll compressor shown in FIG. 1.

FIG. 6 is a diagram showing the relationship between the rotation angle of the crankshaft 11 rotated during the compression action, i.e., the orbiting angle θ* while the orbiting scroll member 27 is being orbitally driven while being revolved, and the displacement V, and FIG. 7 is a diagram showing the relationship between the orbiting angle θ* and the compression chamber temperature T. In FIGS. 6 and 7, curves 2D show a volume curve and a temperature curve of a typical scroll compressor (two-dimensional compression) having no step portion in the spiral wrap, and curves 3D show a volume curve and a temperature curve of the scroll compressor 1 capable of three-dimensional compression.

As shown in FIG. 6, in the typical scroll compressor, as shown by the curve 2D, compression is performed such that the displacement volume Vs during intake cut-off, shown by a point A, gradually decreases, via a point B, to the displacement volume Vdis during discharge, shown by a point D. On the other hand, in the scroll compressor 1 capable of three-dimensional compression, the displacement volume Vs during intake cut-off, shown by the point A, decreases to a point B' as a result of compression on the outer peripheral side (Lout), as shown by the curve 3D. After the point B' (equal to the point B), the volume decreases to a point C' because compression in the wrap height direction is applied by the step portion. Then, as a result of compression on the inner peripheral side (Lin), compression is performed such that the displacement volume gradually decreases, from the point C', to the displacement volume Vdis during discharge, shown by a point D'. The range between the point B' and the point C' shows the orbiting angle range where the step portions 25E and 27E overlap the compression chamber 29 moved while the volume is gradually reduced from the outer peripheral side toward the center side. It is understood, from the foregoing description, that the rate of decrease of the displacement volume V (volume change rate) is larger in the scroll compressor 1 capable of three-dimensional compression than in the typical scroll compressor, indicated by the curve 2D.

FIG. 7 shows the rate of decrease of volume in the above-described compression process converted into temperature on the basis of the following expression, according to polytropic compression.

$$T=(Vs/V_{(\theta^*)})^{k-1}*Ts$$

As shown in FIG. 7, in the typical scroll compressor, as shown by the curve 2D, compression is performed such that the temperature Ts during intake cut-off, shown by a point A, gradually increases, via a point B, to the temperature Tdis during discharge, shown by a point D. On the other hand, in the scroll compressor 1 capable of three-dimensional compression, as shown by the curve 3D, the temperature Ts during intake cut-off, shown by the point A, increases to a point B', and then increases to a point C' because compression in the wrap height direction is applied by the step portion from this point, which increases the rate of decrease of volume. Thereafter, compression is performed such that the temperature gradually increases from the point C' to the temperature Tdis during discharge, shown by a point D'. The range between the point B' and the point C' shows the orbiting angle range where the step portions 25E and 27E overlap the compression chamber 29 moved while the volume is gradually reduced from the outer peripheral side toward the center side. It is understood, from the foregoing description, that the compression chamber temperature T is higher in the scroll compressor 1 capable of three-dimensional compression than in the typical scroll compressor indicated by the curve 2D, at the same orbiting angle θ*.

Furthermore, in FIG. 6, $V_{(F)}$ shows the volume of the compression chamber 29 in the engaged state shown in FIG. 3. The orbiting angle θ* at this time is F (θ*=F), which is just before the point C'. As shown in FIG. 7, the compression chamber temperature at this orbiting angle F (θ*=F) is $T_{(F)}$, which is a temperature substantially close to the point C'. This shows that, in portions on the outer peripheral side of the step portions 25E and 27E of the spiral wraps 25B and 27B, where the wrap height is large, the temperature is highest at the step portions 25E and 27E, and the temperature thereof is almost equal to the temperature at the point C'.

From the foregoing description, the following can be concluded.

(1) The temperature of the compression chamber is higher in the scroll compressor 1 capable of three-dimensional compression than the typical scroll compressor (two-dimensional compression), at the same orbiting angle.

(2) The step portions 25E and 27E are most affected by heat generated by compression, and the temperature of the step portions 25E and 27E is highest at the portion where the wrap height is large.

Thus, there is a problem specific to the conventional scroll compressor capable of three-dimensional compression in that displacement in the vicinity of the step portions of the wrap top surfaces 25C and 27C, in the height direction of the spiral wraps 25B and 27B, due to thermal expansion also increases locally, which locally narrows the gaps between the tip seals 51 and 53 and the bottom surfaces 25I and 27I of the counterpart scroll member and the gaps on the back surfaces of the tip seals 51 and 53 during thermal deformation. This makes it difficult for back-pressure (gas being compressed) to enter the back surfaces of the tip seals 51 and 53 from the step-portion ends. As a result, the function of the tip seals 51 and 53 provided on the spiral wraps 25B and 27B, on the outer peripheral side of the step portions 25E and 27E, is degraded, which causes performance deterioration or performance variation due to gas leakage. Accordingly, in order to make the tip seals 51 and 53 provided on the top surfaces 25G and 27G on the outer peripheral side of the step portions 25E and 27E of the spiral wraps 25B and 27B function normally and in order to obtain the resulting sealing effect, a heat countermeasure against the aforementioned problem is essential.

In this embodiment, as described above, the back-pressure introducing portions 55 and 57 formed of the deep bore portions 25N and 27N that are bored slightly more deeply than the groove bottom surface of the other portion are provided as the heat countermeasure, at the step-portion ends of the tip seal grooves 25L and 27L formed in the top surfaces 25G and 27G on the outer peripheral side of the step portions 25E and 27E (refer to FIGS. 4A, 4B, 4C, and 5A). Accordingly, even when the vicinity of the step portions 25E and 27E thermally expands due to the effect of compression heat whose temperature becomes highest, and is displaced in the wrap height direction, the gaps at the back-pressure introducing portions 55 and 57 provided at the back surfaces of the tip seals 51 and 53 are not narrowed, whereby it is possible to assuredly introduce back-pressure (gas being compressed) to the back surface sides of the tip seals 51 and 53 through the back-pressure introducing portions 55 and 57.

Thus, it is possible to absorb deformation of the spiral wraps 25B and 27B due to thermal expansion to make the tip seals 51 and 53 provided on the outer peripheral side of the step portions 25E and 27E function normally. That is, by floating the entirety, in the length direction, of the tip seals 51 and 53 on the outer peripheral side and urging the tip seals 51 and 53 against the bottom surfaces 25I and 27I of the counterpart scroll members 25 and 27 using back-pressure (gas being compressed) introduced through the back-pressure introducing portions 55 and 57, the top surfaces 25G and 27G on the outer peripheral side of the step portions 25E and 27E of the spiral wraps 25B and 27B can be assuredly sealed.

Figure 8:
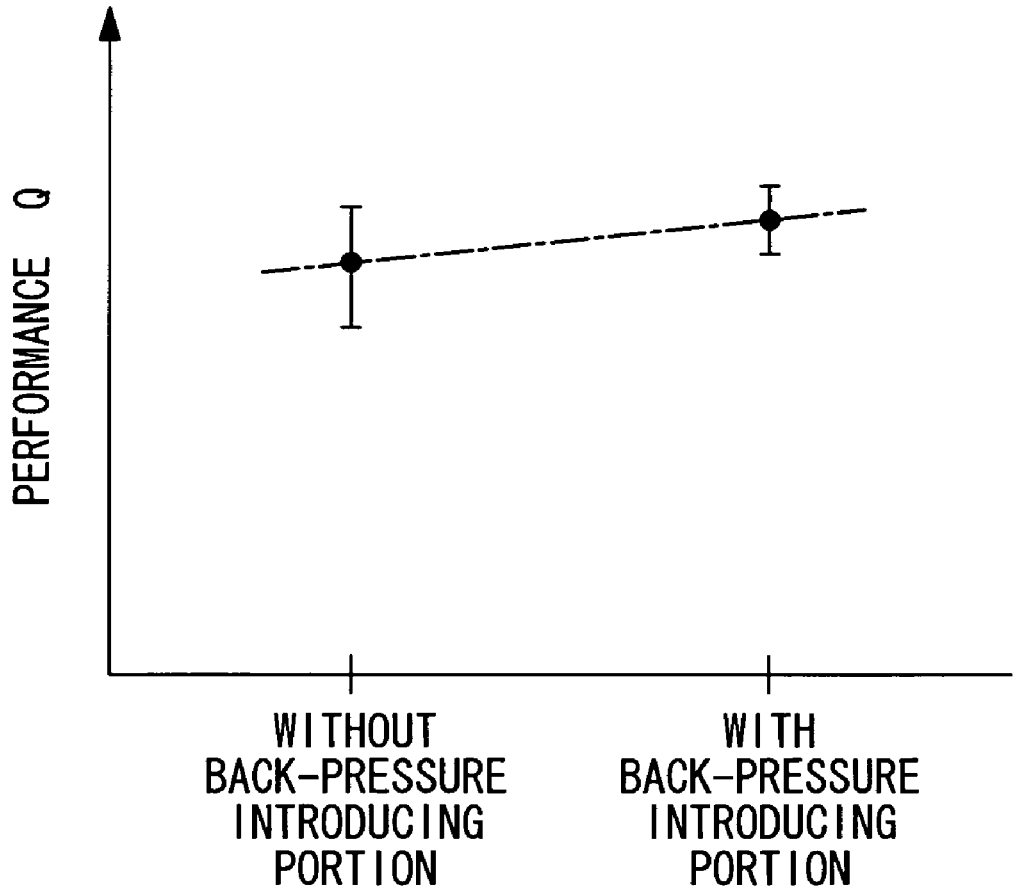
FIG. 8 is a diagram for explaining performance improvement of the scroll compressor shown in FIG. 1.

As a result, as shown in FIG. 8, without the back-pressure introducing portion, gas leakage from the top surfaces 25G and 27G on the outer peripheral side of the step portions 25E and 27E of the spiral wraps 25B and 27B varies the performance, causing performance deterioration. However, the provision of the back-pressure introducing portions 55 and 57 reduces gas leakage, which can reduce relative variation in performance and solve the resulting performance deterioration. Accordingly, it is possible to achieve performance stabilization and performance improvement of the scroll compressor capable of three-dimensional compression.

In addition, because the back-pressure introducing portions 55 and 57 can be formed of the deep bore portions 25N and 27N, formed by boring the groove bottom surfaces at the step-portion ends of the tip seal grooves 25L and 27L more deeply than the groove bottom surface of the other portion, or can be formed of the notches 51A and 53A, formed by partially removing the back surfaces (bottom surfaces) at the step-portion ends (inner peripheral ends) of the tip seals 51 and 53, the back-pressure introducing portions 55 and 57 can be easily formed. The back-pressure introducing portions 55 and 57 absorb thermal deformation, making the tip seals 51 and 53 on the outer peripheral side of the step portions function normally and reducing gas leakage occurring on the outer peripheral side of the step portions of the spiral wraps. Accordingly, thermal deformation of the step portions can be easily countered at a low cost by partially improving the existing components, without adding new components.

Second Embodiment

A second embodiment of the present invention will be described below with reference to FIGS. 4A, 4B, and 4C.

This embodiment is different from the first embodiment in that the structure in the vicinity of the step portions 25E and 27E of the tip seal grooves 25L and 27L is further specified. Because the other points are the same as that according to the first embodiment, an explanation thereof will be omitted.

Figure 4A:
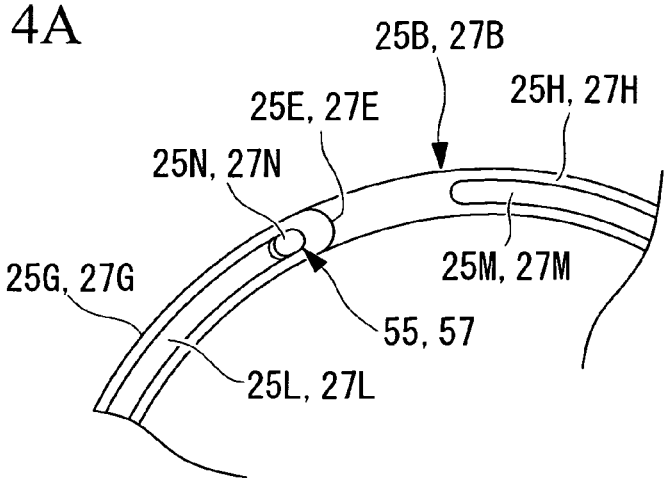
FIG. 4A is a partial plan view of the vicinity of step portions of the fixed scroll member and the orbiting scroll member of the scroll compressor shown in FIG. 1.
Figure 4B:
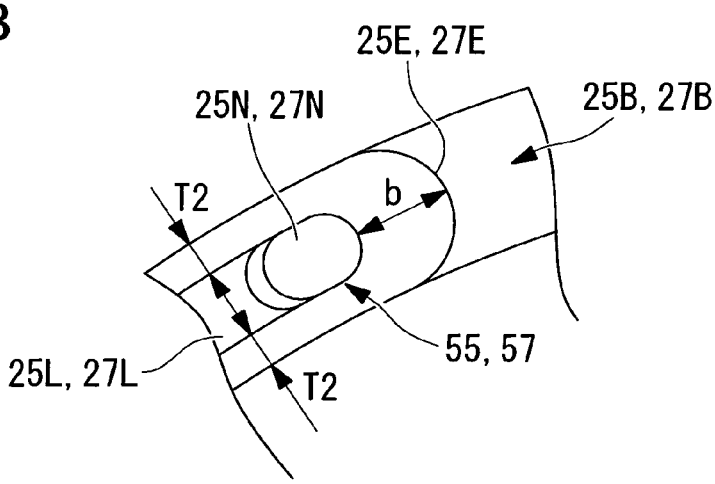
FIG. 4B is a partial enlarged plan view of the vicinity of the step portions of the fixed scroll member and the orbiting scroll member of the scroll compressor shown in FIG. 1.
Figure 4C:
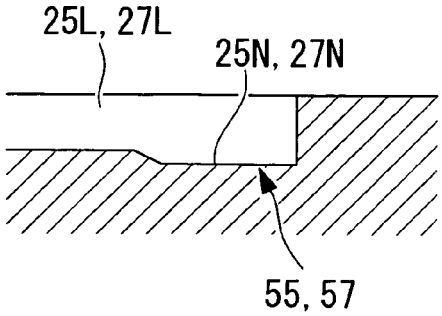
FIG. 4C is a sectional view of the vicinity of the step portions of the fixed scroll member and the orbiting scroll member of the scroll compressor shown in FIG. 1.

In this embodiment, as shown in FIGS. 4A, 4B, and 4C, the width of the edges formed at the ends of the step portions 25E and 27E of the tip seal grooves 25L and 27L is set wider than the width of the edge of the other portion, to increase the strength of the edges.

That is, the width, b, of the edges formed at the step-portion ends of the tip seal grooves 25L and 27L provided in the top surfaces 25G and 27G is set larger than the width, T2, of the edges formed along and on both sides of the tip seal grooves 25L and 27L, that is, b>T2.

It is preferable that the edge width b with respect to the edge width T2 be set in the range of b≦2.5*T2, and more specifically, in the range of 1 mm<b≦2.5 mm.

When the top surfaces 25G and 27G are provided with the tip seal grooves 25L and 27L, because the more the width, b, of the edges formed at the step-portion ends is reduced, the more the region without the tip seal can be reduced, the amount of gas leakage during compression can be reduced. On the other hand, as a feature of the scroll compressor capable of three-dimensional compression, the step portions 25E and 27E on the top surfaces 25C and 27C of the spiral wraps 25B and 27B face the step portions 27F and 25F of the bottom surfaces 25D and 27D, respectively, and a reduction in the amount of gas leakage between these step portions is important. Therefore, fine gaps are left between the respective step portions, or the step portions are arranged in light contact with each other in a slidable manner. However, a heavy load may act on the step portions 25E and 27E of the spiral wraps 25B and 27B because of the influence of errors in assembly, thermal deformation, or the like. In such a case, if the edge width, b, of the tip seal grooves 25L and 27L is made too small, the thinned edges of the step-portion ends of the tip seal grooves 25L and 27L may be damaged because of insufficient rigidity.

In this embodiment, taking the above-described point into consideration, the width, b, of the edges formed at the step-portion ends of the tip seal grooves is made larger than the width, T2, of the edges formed on both sides of the tip seal grooves, that is, b>T2. Therefore, it is possible to increase the rigidity of the step-portion ends of the tip seal grooves 25L and 27L. Thus, it is possible to secure the necessary rigidity of the step-portion ends of the tip seal grooves 25L and 27L while gas leakage is reduced as much as possible to maintain the performance, and to prevent the edges at the step-portion ends from being damaged by unforeseen circumstances.

In particular, in this embodiment, because the edge width b is set such that b≦2.5*T2, or 1 mm<b≦2.5 mm, it is possible to secure the necessary rigidity of the step-portion ends of the tip seal grooves 25L and 27L while reducing the amount of gas leakage as much as possible to maintain the performance, by maintaining the edge width b portion, to which the tip seals 51 and 53 do not extend whereby the effect thereof cannot be obtained, in the optimum range, without unnecessarily enlarging it. This embodiment may also be effectively used to reduce the amount of gas leakage at the step portions 25E and 27E of the scroll compressor having no back-pressure introducing portions 55 and 57, as described in the first embodiment.

Third Embodiment

Next, a third embodiment of the present invention will be described with reference to FIGS. 9A and 9B.

This embodiment is different from the first embodiment in that the structure in the vicinity of the step portions 25E and 27E of the tip seal grooves 25L and 27L and the structure of the tip seals 51 and 53 are changed. Because the other points are the same as that according to the first embodiment, an explanation thereof will be omitted.

Figure 9A:
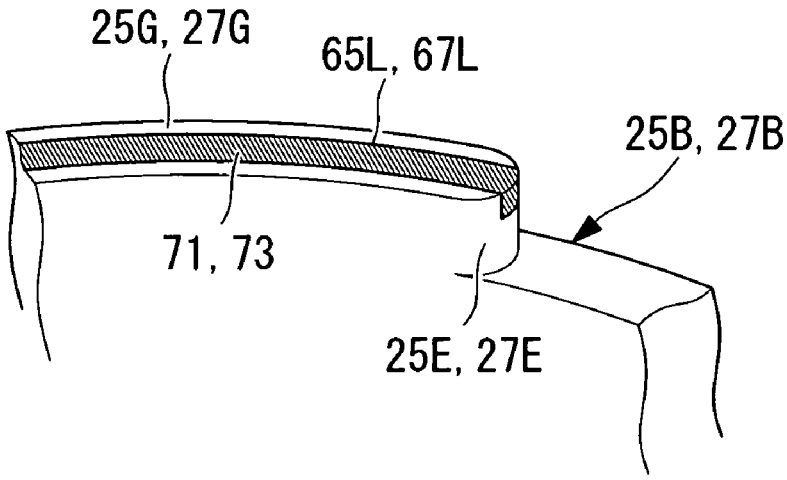
FIG. 9A is a partial perspective view of the vicinity of step portions of a fixed scroll member and an orbiting scroll member of a scroll compressor according to a third embodiment of the present invention.
Figure 9B:
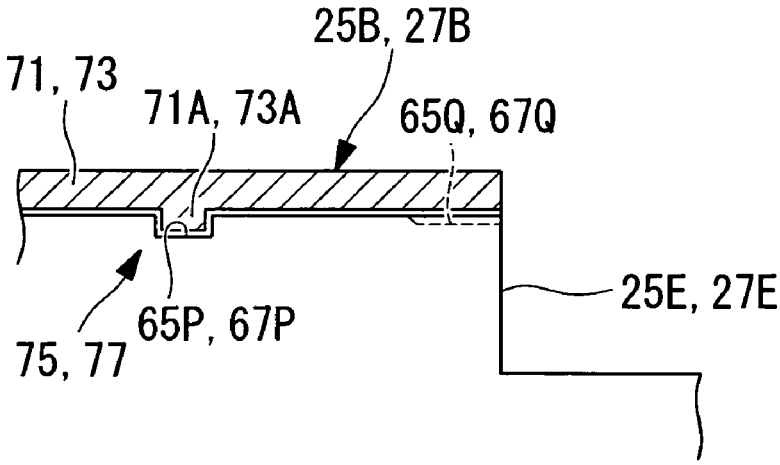
FIG. 9B is a longitudinal sectional view of the partial perspective view of the vicinity of the step portions of the fixed scroll member and the orbiting scroll member of the scroll compressor according to the third embodiment of the present invention.

In this embodiment, as shown in FIGS. 9A and 9B, tip seal grooves 65L and 67L are formed in the top surfaces 25G and 27G on the outer peripheral side of the step portions 25E and 27E of the spiral wraps 25B and 27B such that they penetrate the step portions 25E and 27E. Tip seals 71 and 73 fitted to the tip seal grooves 65L and 67L are also provided such that they extend to the ends of the tip seal grooves 65L and 67L.

In addition, in the above-described structure, because the tip seals 71 and 73 slide out of the tip seal grooves 65L and 67L, movement preventing portions 75 and 77 for preventing the tip seals 71 and 73 from moving in the spiral direction are provided at at least one place in the spiral direction. These movement preventing portions 75 and 77 may be formed of dowels 71A and 73A provided on the back surfaces of the tip seals 71 and 73 and recesses 65P and 67P provided in the tip seal grooves 65L and 67L, to which the dowels 71A and 73A are fitted.

According to this embodiment, as described above, the tip seal grooves 65L and 67L are provided such that they penetrate the step-portion ends of the step portions 25E and 27E, and the tip seals 71 and 73 are provided such that they extend to the ends of the tip seal grooves 65L and 67L. Therefore, even when the vicinity of the step portions 25E and 27E of 25B and 27B is displaced in the wrap height direction because of thermal expansion, such displacement is absorbed to assuredly introduce back-pressure (gas being compressed) from the penetrated portions of the tip seal grooves 65L and 67L, leading to the step portions 25E and 27E, to the back surfaces of the tip seals 71 and 73, making it possible to urge the tip seals 71 and 73 against the bottom surfaces 25I and 27I of the counterpart scroll members 25 and 27 using the back-pressure. This enables the top surfaces 25G and 27G of the spiral wraps 25B and 27B to be assuredly sealed, and gas leakage occurring on the outer peripheral side of the step portions 25E and 27E of the spiral wraps 25B and 27B to be reduced. Accordingly, it is possible to prevent performance deterioration or performance variation due to gas leakage occurring on the outer peripheral side of the step portions 25E and 27E, and to achieve performance stabilization and performance improvement of the scroll compressor 1 capable of three-dimensional compression.

In addition, because the provision of the movement preventing portions 75 and 77 formed of the dowels 71A and 73A and the recesses 65P and 67P prevents the tip seals 71 and 73 from moving in the spiral direction, it is possible to assuredly prevent the tip seals 71 and 73 from sliding out of the penetrated portions of the tip seal grooves 65L and 67L. Moreover, the movement preventing portions 75 and 77 do not affect the structures or strength of the spiral wraps 25B and 27B and the tip seals 71 and 73 at all, and the movement preventing portions 75 and 77 can be easily formed, and attachment of the tip seals 71 and 73 can also be easily performed.

Because it is possible to form the dowels 71A and 73A, to be provided on the back surfaces of the tip seals 71 and 73, using a mold during plastic molding, and it is possible to easily process the recesses 65P and 67P in the tip seal grooves 65L and 67L, to which the dowels 71A and 73A will be fitted, using an end mill during machining of the tip seal grooves 65L and 67L, they can be easily formed at a relatively low cost. By making the height of the dowels 71A and 73A provided on the tip seals 71 and 73 and the thickness of the tip seals 71 and 73 substantially the same, movement can be more assuredly prevented.

In addition, in the above-described embodiment, to ensure the introduction of back-pressure to the back surface sides of the tip seals 71 and 73, as shown by a dashed line in FIG. 9B, back-pressure introducing recesses 65Q and 67Q may be provided in the vicinity of the penetrated portions of the tip seal grooves 65L and 67L, leading to the step portions 25E and 27E, or, back-pressure introducing portions may be formed by providing chamfers, notches, or the like in entrance portions of the tip seal grooves 65L and 67L or ends of the tip seals 71 and 73. This makes the tip seals 71 and 73 function more reliably.

The present invention is not limited to the invention according to the above-described embodiments, and suitable modifications may be made so long as they do not depart from the spirit of the invention. For example, although an open-type scroll compressor is described as an example in the above-described embodiments, the present invention may be equally applied to a scroll compressor of a type having an integral built-in motor. Furthermore, it is not ruled out that a structure similar to that according to the above-described embodiments is applied also to the tip seals 52 and 54 and the tip seal grooves 25M and 27M on the inner peripheral side, in addition to the tip seals 51 and 53 and 71 and 73 on the outer peripheral side of the step portions 25E and 27E.

In the above-described embodiments, although the scroll compressor capable of three-dimensional compression in which the fixed scroll member 25 and the orbiting scroll member 27 are each provided with one step portion is described, if such step portions exist at two or more places over the central portion to the outer periphery, it is effective to apply the present invention to each of such step portions. Moreover, in the above-described embodiments, although the scroll compressor in which the fixed scroll member 25 and the orbiting scroll member 27, forming a pair, each have a step portion on the top surfaces 25C and 27C and the bottom surfaces 25D and 27D of the spiral wraps 25B and 27B, is described as an example, the structure described in the present invention is of course also effective in a scroll compressor in which at least one of the fixed scroll member 25 and the orbiting scroll member 27 has a step portion on the top surfaces 25C and 27C of the spiral wraps 25B and 27B and the other bottom surfaces 25D and 27D.

The invention claimed is:

1. A scroll compressor having a step portion on each of a top surface and a bottom surface of a spiral wrap of a fixed scroll member and an orbiting scroll member pair, each formed of an end plate and the spiral wrap mounted upright thereon, a height of the spiral wrap on an outer peripheral side of the step portion being made higher than a height of the spiral wrap on an inner peripheral side, the scroll compressor being configured for three-dimensional compression in a circumferential direction and a height direction of the spiral wrap, the top surfaces on the outer peripheral side and on the inner peripheral side of the spiral wrap each being provided with a tip seal, wherein a back-pressure introducing portion where a gap between a back surface at a step-portion end of the tip seal and a groove bottom surface of a tip seal groove is made larger than a gap at the other portion is provided between the step-portion end of the tip seal provided on the top surface on the outer peripheral side of the spiral wrap and the tip seal groove to which the tip seal is fitted, and wherein $b>T2$ holds where b is the width of an edge formed at the step-portion end of the tip seal groove and T2 is the width of edges formed along and on both sides of the tip seal groove.

2. The scroll compressor according to claim 1, wherein the back-pressure introducing portion is formed by boring the groove bottom surface at the step-portion end of the tip seal groove more deeply than the groove bottom surface of the other portion.

3. The scroll compressor according to claim 1, wherein the back-pressure introducing portion is formed by providing a notch in the back surface at the step-portion end of the tip seal.

4. The scroll compressor according to claim 1, wherein the edge width b with respect to the edge width T2 is set to be $b \leqq 2.5*T2$.

5. The scroll compressor according to claim 1, wherein the edge width b is set to be $1\ mm<b \leqq 2.5\ mm$.

6. The scroll compressor according to claim 1, wherein the step-portion end of the tip seal groove to which the tip seal is fitted penetrates through to the step portion, the tip seal groove being provided in the top surface on the outer peripheral side of the spiral wrap, the tip seal fitted to the tip seal groove is provided such that it extends to an end of the tip seal groove, and a movement preventing portion for preventing the tip seal from moving in a spiral direction is provided at least one place in the spiral direction.

7. The scroll compressor according to claim 6, wherein the movement preventing portion is formed of a dowel provided on one of the tip seal and the tip seal groove and a recess to which the dowel is fitted, provided in the other.

8. The scroll compressor according to claim 6, wherein a back-pressure introducing portion is provided at the step-portion end of the tip seal or the tip seal groove.

9. A scroll compressor having a step portion on each of a top surface and a bottom surface of a spiral wrap of a fixed scroll member and an orbiting scroll member pair, each formed of an end plate and the spiral wrap mounted upright thereon, a height of the spiral wrap on an outer peripheral side of the step portion being made higher than a height of the spiral wrap on an inner peripheral side, the scroll compressor being configured for three-dimensional compression in a circumferential direction and a height direction of the spiral wrap, the top surfaces on the outer peripheral side and on the inner peripheral side of the spiral wrap each being provided with a tip seal, wherein b>T2 holds where b is the width of an edge formed at the step-portion end of the tip seal groove to which the tip seal is fitted, the tip seal groove being provided in the top surface on the outer peripheral side of the spiral wrap, and T2 is the width of edges formed along and on both sides of the tip seal groove.

* * * * *